US006286412B1

(12) United States Patent
Manring et al.

(10) Patent No.: US 6,286,412 B1
(45) Date of Patent: Sep. 11, 2001

(54) METHOD AND SYSTEM FOR ELECTROHYDRAULIC VALVE CONTROL

(75) Inventors: Noah D. Manring, Chillicothe; Lifei Yu, Dunlap, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/444,624

(22) Filed: Nov. 22, 1999

(51) Int. Cl.[7] ..... F15B 11/10
(52) U.S. Cl. ..... 91/433
(58) Field of Search ..... 91/433

(56) References Cited

U.S. PATENT DOCUMENTS

| | | | | |
|---|---|---|---|---|
| 3,878,765 | * | 4/1975 | Walters et al. | 91/433 |
| 4,031,813 | * | 6/1977 | Walters et al. | 91/433 |
| 4,164,167 | * | 8/1979 | Imai et al. | 91/433 X |
| 4,362,084 | * | 12/1982 | Walters | 91/433 X |
| 4,598,626 | * | 7/1986 | Walters et al. | 91/433 |
| 5,560,387 | * | 10/1996 | Devier et al. | 137/1 |
| 5,911,244 | | 6/1999 | Long et al. . | |
| 5,913,577 | | 6/1999 | Arndt . | |

OTHER PUBLICATIONS

AIAA–88–3134, Analytical Algorithm for the Design of Valve Contours, Esmat Bekir, Rockwell, International/ Rocketdyne Division, Canoga Park.

* cited by examiner

*Primary Examiner*—John E. Ryznic
(74) *Attorney, Agent, or Firm*—Blackwell Sanders Peper Martin

(57) ABSTRACT

An electrohydraulic valve control system which enables simultaneous flow and pressure control for operating an implement or other work element associated with a work machine through the use of a single control valve design, the present control system comparing the actual valve output flow rate of the hydraulic fluid flowing through the valve to a desired valve output flow rate and thereafter modifying the input flow rate to the valve based upon the difference between the actual valve output flow rate and the desired valve output flow rate. The desired valve output flow rate is determined based upon the actual load pressure being exerted against the implement or work element and the operator input signal generated by the operator upon activation of an operator input control mechanism used to control the operation of the implement or work element. In this regard, the control system stores a plurality of pressure-flow curves, which determine the desired valve, output flow rate based upon the actual load pressure and the operator input signal. The actual valve output flow rate is determined through the use of a flow sensor, or through the use of a flow rate calculator which uses the output signal from various pressure sensors and a spool displacement sensor to calculate the actual valve output flow rate based upon inputs from the appropriate sensors.

17 Claims, 4 Drawing Sheets

METHOD AND SYSTEM FOR ELECTROHYDRAULIC VALVE CONTROL

TECHNICAL FIELD

This invention relates generally to electrohydraulic valve control and, more particularly, to a method and system for simultaneous pressure and flow control through a single electrohydraulic valve design.

BACKGROUND ART

Implements on work machines are commonly operated through the use of hydraulics. Control valves play an important role in controlling the flow and pressure of the hydraulic fluid as it is distributed to the implements or other work elements and/or attachments associated with a particular work machine. Such valves can be controlled in a number of ways. They can be controlled mechanically using pilot pressure for hydraulic activation such that the valve can either provide constant flow or constant pressure, or with the increasing demand for electrohydraulics, such valves can also be controlled via electronic solenoids or other electronic actuator means either with or without feedback, depending upon the requirements of the application.

To achieve open-loop control of such valves, actuators without feedback are used. However, some applications require more accuracy, less hysteresis, better repeatability, fast response and greater power capacity. To meet these requirements, a closed-loop control with feedback is required. Most available closed-loop feedback control systems presently on the market include either spool position feedback or pressure feedback. When spool position feedback is used, a constant flow rate can be achieved. When pressure feedback is used, a constant pressure can be achieved.

There are two types of electrohydraulic valve designs often used to control the operation of a wide variety of different types of implements used on a wide variety of different types of work machines such as front end loaders, backhoe loaders, dozers and other earthmoving and construction equipment, namely, an open center valve and a closed center valve. The slot designs of the spools of each valve, which are quite complex, dictate their performance characteristics. An open center valve uses the setting of the spool position to provide constant flow, regardless of load, which in turn provides the implement or work element with a constant speed of movement. Such valves are relatively inexpensive and, more importantly, are load pressure sensitive so that the operator can learn to "feel" the pressure being exerted against the implement or its actuating cylinder and thus better control the operation and movement of the implement. However, open center valves cannot provide a constant flow at high pressure. In addition, such valves are associated with high power losses and are thus inefficient, especially for heavy loads operating at low speeds. A closed center valve, on the other hand, provides only the flow required to meet the implement demand and operates with a fixed pressure margin above the highest system load. These "constant pressure" valves are typically used in slow speed, high load applications. As a result, this type of valve is more efficient and more compatible with closed-loop control performance characteristics as compared to open center valves. However, such closed center valves are characterized by low damping and thus lack the pressure control of open center valves.

Implements are used in a wide variety of different applications which require the performance characteristics of both open center valves (in particular, pressure control) and closed center valves (in particular, flow control). For example, in a backhoe loader application when the shovel is digging, a low fluid flow rate and high pressure to the implement (shovel) is normally required. On the other hand, when the shovel is moved upwardly and rotated to dump the material at a new location, a high flow rate and low pressure to the implement (shovel) is normally required. With only constant flow control as provided by closed center valves, if the shovel happens to hit an underground pipe or other obstruction, the shovel will continue to move thereby breaking the pipe or other object due to the lack of pressure control which is provided through the use of open center valves. However, with only constant pressure control as provided by open center valves, the shovel will stop digging if a pipe or other obstruction is encountered, but the speed of movement of the shovel will be reduced with a full shovel as compared to an empty shovel due to the lack of flow control provided by closed center valves.

Therefore, a desired implement control system should have pressure and flow control flexibility such that both the flow and pressure can be simultaneously controlled. Moreover, such control should be software-controlled so as not to depend upon the specific valve design used. By controlling both flow and pressure simultaneously with a single valve design, the performance of hydraulic machine implements including their associated actuating mechanisms such as actuating cylinders, motors and the like over a variety of different applications can be optimized.

Accordingly, the present invention is directed to overcoming one or more of the problems as set forth above.

DISCLOSURE OF THE INVENTION

In one aspect of the present invention, a control system is disclosed which provides simultaneous flow and pressure control for an electrohydraulic control valve used to control the operation of an implement or work element associated with a work machine, the implement or work element being operated and controlled by an operator through the use of operator input control mechanisms generating operator input signals upon the application thereof. The control valve is connected to the work element via a hydraulic circuit including an actuating cylinder or other actuating means. The control system includes a flow sensor adapted to determine an actual valve output flow rate of the hydraulic fluid flowing from the control valve, and a pressure sensor positioned in fluid communication with the actuating cylinder or other actuating means adapted to sense the actual load pressure being applied to the cylinder or other actuator. A desired valve output flow rate determinator is in communication with the pressure sensor and the operator input signals and is adapted to receive the load pressure and operator input signals in order to determine a desired valve output flow rate based thereon. A comparator in communication with the flow sensor and the desired valve output flow rate determinator compares the actual valve output flow rate and the desired valve output flow rate to produce a comparator output signal representing the difference therebetween. An electronic controller or other processor means is coupled in communication with both the comparator and the control valve and is operable to receive the comparator output signal. In response to the comparator output signal, the control outputs an appropriate signal to the control valve to modify the input flow rate to the valve such that the desired control valve output flow rate is achieved.

In another aspect of the present invention, the present control system utilizes a pressure drop determinator adapted to determine a pressure drop across the control valve and a spool displacement sensor adapted to determine the displacement associated with the control valve spool relative to its neutral position or some other predetermined position. An actual valve output flow rate calculator receives the spool displacement and the pressure drop data and, using such data, calculates the actual valve output flow rate of hydraulic fluid flowing from the control valve. This control system arrangement replaces the use of the on-line flow sensor disclosed in the previous embodiment due to the cost of adding a flow sensor to the system as well as due to the time delay involved in receiving a signal response from such sensor. The remaining portion of this embodiment of the present control system is substantially identical to the above-desired embodiment in that the actual value output flow rate will be compared to the desired value output flow rate and an appropriate signal will be outputted by the electronic controller to the control valve to modify the output flow rate to achieve the desired rate.

In yet another aspect of the present invention, a method is disclosed for simultaneously controlling the flow and pressure of an electrohydraulic valve connected in fluid communication to an implement or other work element of a work machine via an appropriate hydraulic circuit including an actuating cylinder or other actuating means, the work machine being operated by an operator through the use of operator input control mechanisms generating operator input signals upon the application thereof. The present method includes the steps of determining an actual valve output flow rate of the hydraulic fluid flowing from the control valve, sensing a load pressure being applied to the implement or work element, determining a desired control valve output flow rate in response to the load pressure and the operator input signals, comparing the actual valve output flow rate to the desired valve output flow rate, and modifying the input flow rate to the control valve based upon the difference between the actual valve output flow rate and the desired valve output flow rate to achieve the desired valve output flow rate from the control valve.

BRIEF DESCRIPTION OF THE DRAWINGS

For a better understanding of the present invention, reference may be made to the accompanying drawings in which.

BEST MODE FOR CARRYING OUT THE INVENTION

Figure 1:
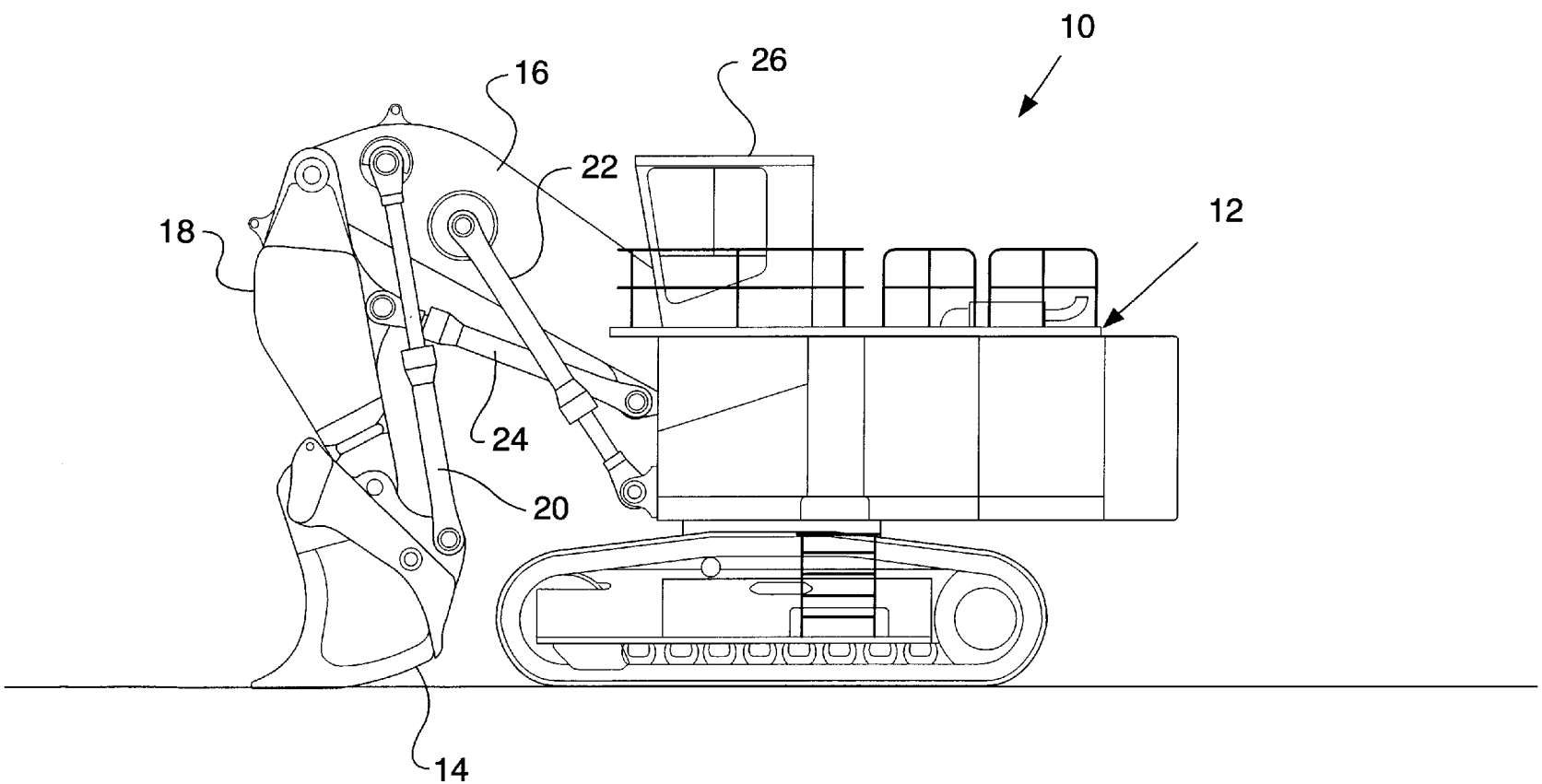
FIG. 1 is a perspective view of a front shovel work machine.

Referring to FIG. 1, a typical work machine 10, such as a front shovel loader, is shown. Work machine 10 includes a mainframe or main body portion 12 which includes an operator cab 26 from which an operator not only controls movement of the work machine 10 but also controls the operation and movement of several work elements such as the implement or front shovel 14, the boom 16 and the stick 18, all of which are connected together as illustrated in FIG. 1 in a convention manner. Implement 14, boom 16 and stick 18 are all controlled via electrohydraulic control valves connected respectively thereto through one or more hydraulic circuits (not shown) which control the operation of implement cylinder 20, boom cylinder 22, and stick cylinder 24. In this regard, one or more hydraulic pumps will supply hydraulic fluid under pressure to the various electrohydraulic control valves, the operation of which valves are typically controlled electrically through the use of an electronic controller or other processing means which outputs appropriate signals to the actuating means of the control valves to control the flow and/or pressure to an actuating cylinder, a motor, or other actuator means coupled to a particular work element or implement. In the particular example illustrated in FIG. 1, appropriate electrohydraulic control valves will meter an appropriate amount of fluid flow to the implement cylinder 20 to control the movement of the particular implement (front shovel) 14 in response to appropriate signals inputted to such control valves via an electronic controller. These signals outputted by the electronic controller to the particular control valves are produced in response to operator input signals generated by activation of certain operator input control mechanisms such as various control levers or electronic joysticks used to control the operation and movement of the particular implement or work element. While the present invention will be described with respect to the type of work machine shown in FIG. 1 and, in particular, with respect to implement 14 as the work element, it can be appreciated by one skilled in the art that the present invention can be used in connection with any type of work machine having any type of work elements controlled through the use of one or more electrohydraulic valves.

Figure 2:
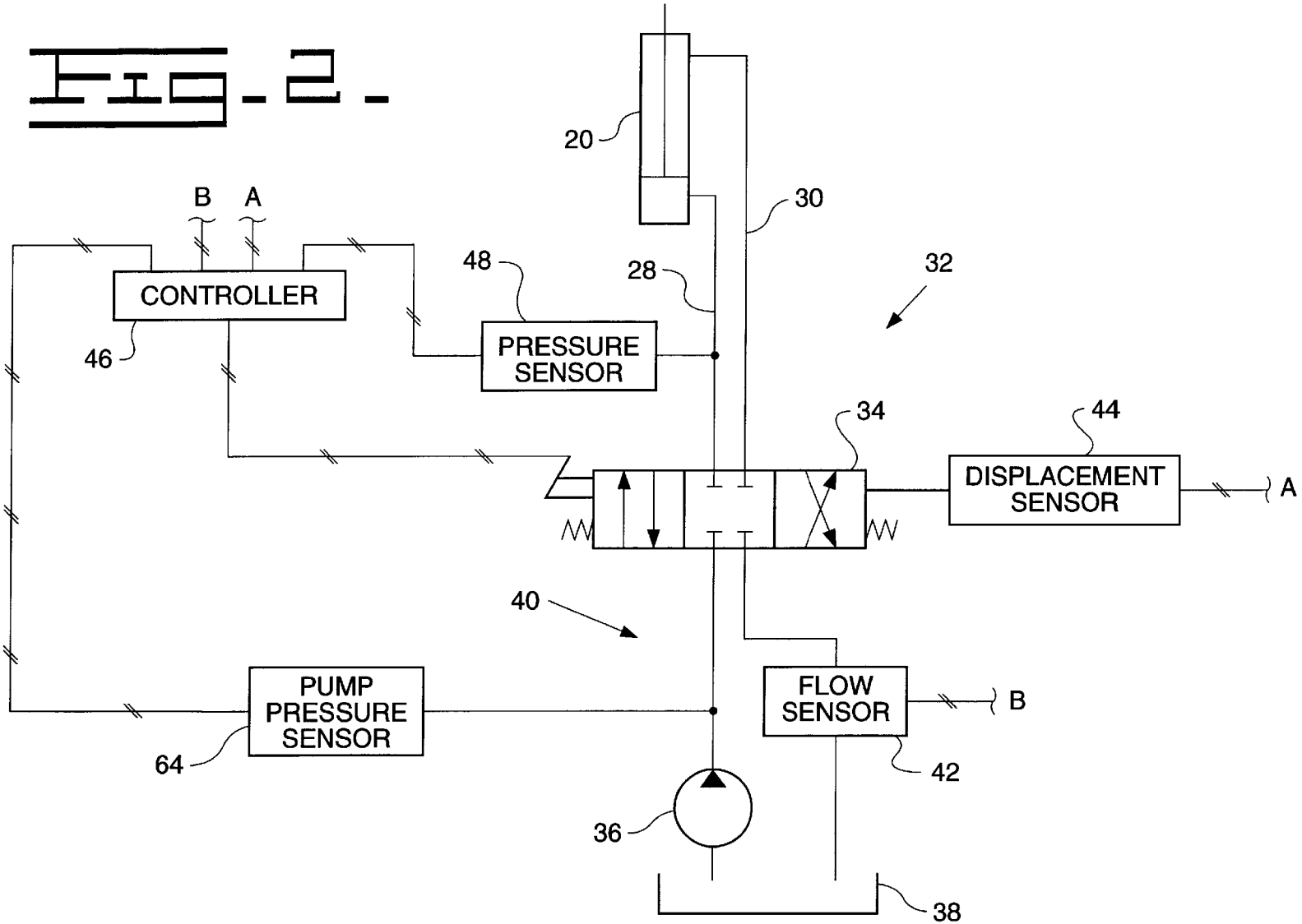
FIG. 2 is a cross-sectional view of a typical control valve used to control the implement or shovel associated with the work machine illustrated in FIG. 1 in combination with the control system of the present invention.

Referring now to FIG. 2, one embodiment of a closed center valve 32 for use in controlling the operation of implement 14 is illustrated. It can be appreciated by one skilled in the art, however, that the present invention can be implemented on any type of valve design. Valve 32 includes a spool 34 which is adapted to move horizontally from right to left and from left to right in response to appropriate signals inputted to the valve actuating means by an electronic controller 46 or other appropriate processor means. An appropriate hydraulic pump 36 is utilized to provide fluid flow under pressure to the implement cylinder 20. In a preferred embodiment, a pump pressure sensor 64 is placed in fluid communication with the pump 36 to sense the fluid output pressure associated with the fluid flow being discharged by pump 36. Tank 38 contains the hydraulic fluid used by the pump 36 to supply pressurized fluid to valve 32 and the position of the spool 34 dictates whether and how much fluid within tank 38 is allowed to flow through valve 32. In this regard, spool 34 as shown in FIG. 2 is positioned in a closed position so as to prohibit hydraulic fluid from flowing from tank 38 through fluid path 40 into valve 32. A displacement sensor 44 is connected to spool 34 in order to sense and determine the displacement of spool 34 relative to some predetermined position such as the closed positioned illustrated in FIG. 2.

Valve 32 is further connected in fluid communication to the actuating implement cylinder 20 via fluid paths 28 and 30, and implement cylinder 20 is further connected to implement 14. The flow and pressure of the fluid through control valve 32 and into and out of implement cylinder 20 causes implement cylinder 20 and thus implement 14 connected thereto to move accordingly. A pressure sensor 48 is likewise placed in fluid communication with implement cylinder 20 in order to sense and determine the fluid pressure flowing into the head portion of cylinder 20. This fluid pressure is representative of the actual load being exerted against the front shovel or implement 14. In this regard, it should be noted that pressure sensor 48 is shown positioned in fluid communication with fluid path 28 leading to the head portion of cylinder 20. It is also recognized that another pressure sensor may be positioned in fluid communication with fluid path 30 leading to the rod portion of cylinder 20 to sense the pressure exerted against that portion of the cylinder. In a preferred embodiment, a flow sensor 42 is also placed in fluid communication with the hydraulic fluid flowing from valve 32 to tank 38 for sensing and determining the actual valve output flow rate of the hydraulic fluid passing through valve 32. An electronic controller 46 is placed in communication with control valve 32 and spool 34 for providing closed loop feedback control to valve 32 as will be further described herein.

Figure 3:
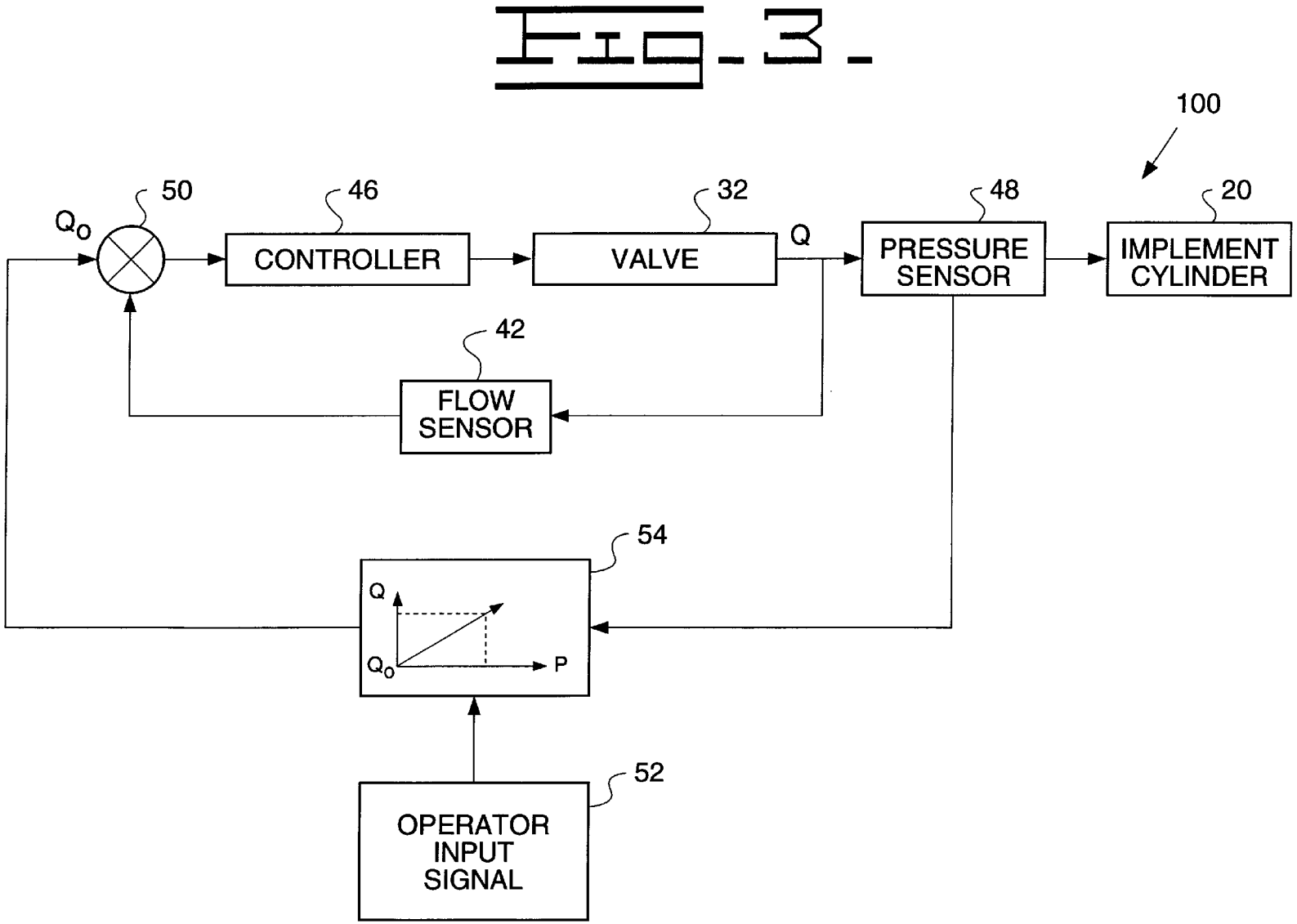
FIG. 3 is a block diagram of one embodiment of the control system of the present invention.

FIG. 3 shows a block diagram of a unique valve control system 100 which provides for the simultaneous control of both fluid flow and pressure through valve 32 regardless of the type of control valve being used. In general, control system 100 represents software that determines and supplies an input flow rate signal to valve 32 that will produce the desired valve output flow rate $Q_o$ therethrough. Specifically, controller 46 is presented with a comparator output signal from a comparator 50, such as a summing junction, which compares the actual valve output flow rate Q, in volts, sensed by flow sensor 42 to a desired valve output flow rate $Q_o$, in volts. The desired valve output flow rate $Q_o$ is determined based upon an operator input signal 52 generated by the operator upon activation of an operator input control mechanism (not shown) such as one or more control levers or joysticks, and the load pressure sensed by pressure sensor 48.

More particularly, control system 100 includes memory (not shown) for storing a plurality of steady state pressure-flow (PQ) curves 54 which define the relationship between the load pressure and the desired valve output flow rate for a given operator input signal 52. The PQ curves can represent pressure control, flow control or a combination of both depending upon the particular application required by the operator. In this regard, it is recognized and anticipated that the relationship between load pressure and the desired output flow rate of valve 32 can be programmed into controller 46 in a wide variety of other formats and other means and techniques well known in the art without departing from the sprit and scope of the present invention. The actual valve output flow rate Q and the desired valve output flow rate $Q_o$ are inputted into comparator 50 to generate the comparator output signal. If the desired valve output flow rate $Q_o$ determined by PQ curves 54 is not the same as the actual valve output flow rate Q sensed by flow sensor 42, controller 46, upon receiving the comparator output signal, will convert the comparator output signal into current (i.e., Amps) and then input the converted comparator output signal to valve 32 which, in turn, converts the converted comparator output signal into millimeters representing the displacement of spool 34 required to produce the desired valve output flow rate $Q_o$ through valve 32. The spool 34 will then move the appropriate amount in the appropriate direction in response to the signal outputted by controller 46. This process is continuously preformed to achieve the desired value output flow rate $Q_o$ through value 32 based upon operator input signal 52. It is recognized that the pump pressure sensor 64 illustrated in FIG. 2 is not necessarily required in the embodiment of FIG. 3.

Figure 4:
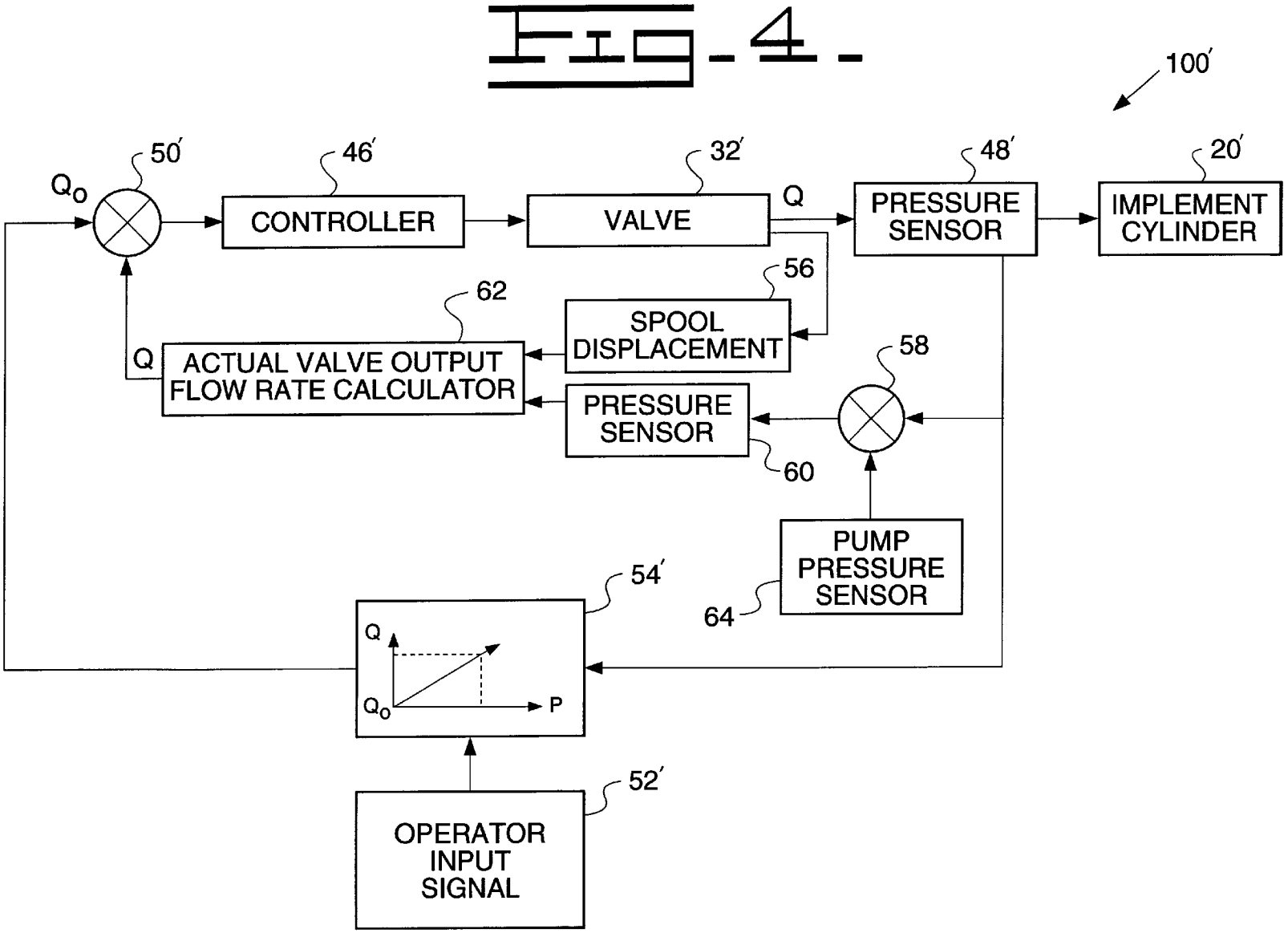
FIG. 4 is a block diagram of another embodiment of the control system of the present invention.

FIG. 4 shows another embodiment of a control system 100' which provides for the simultaneous control of both fluid flow and pressure through a valve 32' regardless of the type of control valve being used. This control system configuration avoids the online flow measurements of control system 100 of FIG. 3 and thus eliminates the need for using flow sensor 42 which can be expensive and which output is subject to time delays as a result of the manner in which such sensors measure flow rate. As an alternative, therefore, control system 100' measures the displacement of the spool associated with the valve 32' such as spool 34 from some predetermined reference position such as the closed position illustrated in FIG. 2 and system 100' also measures a pressure drop 60 across the valve spool in order to calculate the actual valve output flow rate of valve 32'. The displacement of the spool is sensed by a displacement sensor 56 and a signal representative of such displacement is inputted to the actual valve output flow rate calculator 62. A pressure comparator 58, such as a summing junction, compares the output pressure associated with the pump such as pump 36 sensed via pump pressure sensor 64 with the actual load pressure sensed by pressure sensor 48 and determines the pressure drop 60 across the valve spool. The pressure drop 60 will be the difference between the pump output pressure and the load pressure being exerted against cylinder 20 and this difference or pressure drop 60 is likewise inputted to the actual valve output flow rate calculator 62 via a signal representative of such pressure difference. The actual valve output flow rate Q is then determined by the actual valve output flow rate calculator 62 which performs the following calculations in accordance with the below-listed equation in order to calculate the actual valve output flow rate Q, namely, $$Q=Cd\times A\times\sqrt{2\times\Delta P/\rho}$$

Where:

Q=actual flow rate

Cd=discharge coefficient

A=metering area (orifice area)

ΔP=pressure drop 60

ρ=density of the hydraulic fluid

In a preferred embodiment, actual valve output flow rate calculator 62 is stored in the memory (not shown) of controller 46'. In all other respects, control system 100' operates substantially similar to control system 100 wherein comparator 50' will compare the desired valve output flow rate $Q_o$ with the actual computed valve output flow rate Q, and comparator 50' will thereafter output an appropriate signal to controller 46' to modify the input signal to valve 32' to adjust the displacement of the valve spool to achieve the desired valve output flow rate.

INDUSTRIAL APPLICABILITY

As described herein, the control system of the present invention allows an operator of a work machine 10 to simultaneously control the actual valve output flow rate and pressure through a single valve design. Specifically, upon activation of the operator input control mechanism, an operator input signal is sent to the control system. The control system determines a desired valve output flow rate based upon the load pressure sensed by pressure sensor 48 and the operator input signal received. Specifically, the type of command represented by the operator input signal indicates whether flow control, pressure control or both pressure and flow control is desired. The plurality of pressure-flow curves 54 or 54' stored within the memory of the control system are then used to determine the desired valve output flow rate needed to move implement 14 in the desired manner. The desired valve output flow rate is then compared with the actual valve output flow rate either sensed by flow sensor 42 or calculated by the actual valve output flow calculator 62. If the two flow rates are not the same, controller 46 or 46' modifies the input flow rate signal to valve 32 or 32' to produce the desired valve output flow rate from such control valve. The control system continuously monitors the operation of implement 14 so that the performance of the work machine can be optimized.

The present control system has particular utility in any type of hydraulic system which utilizes an electrohydraulic control valve for controlling the operation of any type of work element or other actuating means whether such hydraulic system is utilized in certain types of work machine, or any other type of hydraulically controlled apparatus.

In addition, electronic controllers or modules, or any other type of processor means such as controller 46 or 46' are commonly used in association with work machines and other devices for accomplishing various tasks. In this regard, controller 46 or 46' may typically include processing means, such as a microcontroller or microprocessor, associated electronic circuitry such an input/output circuitry, analog circuits or programmed logic arrays, as well as associated memory. Controller 46 or 46' can therefore be programmed to recognize and receive the appropriate signals from comparator 50 and 50' and, based upon such signal, output appropriate signals to the control valve 32 or 32' so as to modify the displacement of the appropriate spool member to achieve the desired output flow rate for the control valve.

Still further, the various sensors utilized in the present system such as sensor 42, 44, 48, 48' and 64 are well known in the art and a wide variety of different types of spool displacement sensors, flow sensors and pressure sensors may be utilized in the present control system without departing from the sprit and scope of the present invention.

As is evident from the foregoing description, certain aspects of the present invention are not limited to the particular details of the examples illustrated herein. It is therefore contemplated that other modifications and applications using other sensors and methods for determining the actual output flow rate of control valve 32 or 32' as well as other sensors and methods for determining the desired output flow rate for such valves will occur to those skilled in the art. It is accordingly intended that all such modifications, variations and other uses and applications which do not depart from the sprit and scope of the present invention are deemed to be cover by the present invention.

Other aspects, objects and advantages of the present invention can be obtained from a study of the drawings, the disclosure and the appended claims.

What is claimed is:

1. A control system for an electrohydraulic valve used to control the operation of a work element through the use of operator input control mechanisms generating operator input signals upon the application thereof, the valve being connected to the work element via a hydraulic circuit which includes an actuator coupled to the work element for controlling the operation thereof, the control system comprising:

a flow sensor positioned in communication with the valve and adapted to determine an actual valve output flow rate of a hydraulic fluid flowing therethrough, the flow sensor outputting a signal indicative of the actual valve output flow rate;

a pressure sensor positioned in communication with the actuator and adapted to sense a load pressure being applied to the actuator, the pressure sensor outputting a signal indicative of the load pressure;

desired valve output flow rate determinator in communication with the pressure sensor and the operator input control mechanisms for receiving the load pressure signal and the operator input signal and determining a desired valve output flow rate for the valve based thereon, the determinator outputting a signal indicative of the desired valve output flow rate;

a comparator in communication with the flow sensor and the desired valve output flow rate determinator and adapted to receive signals therefrom, said comparator being operable to compare the actual valve output flow rate with the desired valve output flow rate and produce a comparator output signal representing a difference therebetween; and a controller in communication with the comparator and the valve and adapted to receive the comparator output signal and modify an input flow rate signal to the valve based upon the comparator output signal such that the desired valve output flow rate from the valve is achieved.

2. A control system for an electrohydraulic valve used to control the operation of a work element through the use of operator input control mechanisms generating operator input signals upon the application thereof, the valve being connected to the work element via a hydraulic circuit which includes actuator means coupled to the work element for controlling the operation thereof, the control system comprising:

a flow sensor positioned in communication with the valve and adapted to determine an actual valve output flow rate of a hydraulic fluid flowing therethrough, the flow sensor outputting a signal indicative of the actual valve output flow rate;

a pressure sensor positioned in communication with the actuator means and adapted to sense a load pressure being applied to the actuator means, the pressure sensor outputting a signal indicative of the load pressure;

desired valve output flow rate determinator means in communication with the pressure sensor and the operator input control mechanisms for receiving the load pressure signal and the operator input signal and determining a desired valve output flow rate for the valve based thereon, the determinator means outputting a signal indicative of the desired valve output flow rate;

a comparator in communication with the flow sensor and the desired valve output flow rate determinator means and adapted to receive signals therefrom, said comparator being operable to compare the actual valve output flow rate with the desired valve output flow rate and produce a comparator output signal representing a difference therebetween; and a controller in communication with the comparator and the valve and adapted to receive the comparator output signal and modify an input flow rate signal to the valve based upon the comparator output signal such that the desired valve output flow rate from the valve is achieved.

3. The control system as set forth in claim 1 wherein the flow sensor is coupled to the controller and the valve in a closed loop feedback manner, and wherein the desired valve output flow rate determinator means is coupled to the controller, the valve and the pressure sensor in a closed loop feedback manner.

4. The control system as set forth in claim 1 wherein the desired valve output flow rate determinator means comprises a plurality of pressure-flow curves representing a relationship between the load pressure and the desired valve output flow rate based upon the operator input signal.

5. The control system as set forth in claim 1 wherein the comparator is a summing junction.

6. The control system as set forth in claim 1 wherein the actuator means is a hydraulic cylinder.

7. The control system as set forth in claim 1 wherein the work element is a front shovel.

8. A control system for an electrohydraulic valve used to control the operation of a work element through the use of operator input control mechanisms generating operator input signals upon the application thereof, the valve having a spool for controlling fluid flow therethrough, the valve further being connected to the work element via a hydraulic circuit which includes a hydraulic pump for providing fluid flow to the work element and actuator means coupled to the work element for controlling the operation thereof, the control system comprising:

a pressure sensor positioned in communication with the actuator means and adapted to sense a load pressure being applied to the actuator means, the pressure sensor outputting a signal indicative of the load pressure;

pressure drop determinator means for determining a pressure drop across the valve, the pressure drop determinator means outputting a signal indicative of the pressure drop;

a spool displacement sensor positioned in communication with the spool and adapted to determine a displacement of the spool relative to a predetermined position, the spool displacement sensor outputting a signal indicative of the spool displacement;

an actual valve output flow rate calculator adapted to receive the spool displacement signal and the pressure drop signal and calculate an actual valve output flow rate of the hydraulic fluid flowing from the valve, the calculator outputting a signal indicative of the actual valve output flow rate;

desired valve output flow rate determinator means in communication with the pressure sensor and the operator input control mechanisms for receiving the load pressure signal and the operator input signal and determining a desired valve output flow rate for the valve based thereon, the output flow rate determinator means outputting a signal indicative of a desired valve output flow rate;

a comparator in communication with the actual valve output flow rate calculator and the desired flow rate determinator means and adapted to receive signals therefrom, said comparator being operable to compare the actual valve output flow rate with the desired valve output flow rate and produce a comparator output signal representing a difference therebetween; and a controller in communication with the comparator and the valve and adapted to receive the comparator output signal and modify an input flow rate signal to the valve based upon the comparator output signal such that the desired valve output flow rate from the valve is achieved.

9. The control system as set forth in claim 8 wherein the desired valve output flow rate determinator means comprises a plurality of pressure-flow curves representing a relationship between the load pressure and desired valve output flow rate based upon the operator input signal.

10. The control system as set forth in claim 8 wherein the comparator is a summing junction.

11. The control system as set forth in claim 8 wherein the pressure drop determinator means comprises:

a pump pressure sensor positioned in communication with the hydraulic pump for sensing the pump pressure, the pump pressure sensor outputting a signal indicative of the pump pressure; and a pressure comparator in communication with the pressure sensor and the pump pressure sensor and adapted to receive signals therefrom, the pressure comparator being operable to compare the load pressure with the pump pressure to produce a pressure comparator output signal representative of the pressure drop across the valve.

12. The control system as set forth in claim 11 wherein the pressure comparator is a summing junction.

13. The control system as set forth in claim 8 wherein the actuator means is a hydraulic cylinder.

14. A method for controlling an electrohydraulic valve used to control the operation of a work element connected to a work machine through the use of operator input control mechanisms generating operator input signals upon the application thereof, the valve being connected to the work element via a hydraulic circuit which includes actuator means coupled to the work element for controlling the operation thereof and a hydraulic pump for providing fluid flow to the actuating means, the control system comprising:

determining an actual valve output flow rate of the hydraulic fluid flowing from the valve;

sensing a load pressure being applied to the work element;

determining a desired valve output flow rate for the valve based upon the load pressure and the operator input signal;

comparing the actual valve output flow rate to the desired valve output flow rate; and modifying an input flow rate signal to the valve based upon the difference between the actual valve output flow rate and the desired valve output flow rate to achieve the desired valve output flow rate.

15. The method as set forth in claim 14 wherein the step of determining the actual valve output flow rate includes sensing the flow rate of the hydraulic fluid flowing from the valve with a flow sensor.

16. The method as set forth in claim 14 wherein the valve includes a spool for controlling fluid flow therethrough, the step of determining the actual valve output flow rate including:

sensing the displacement of the spool relative to a predetermined position;

sensing the load pressure being applied to the work element;

sensing the pump pressure;

comparing the load pressure and the pump pressure to determine a pressure difference; and calculating an actual valve output flow rate based upon the spool displacement and the pressure difference.

17. The method as set forth in claim 14 wherein the actuating means is a hydraulic cylinder.

* * * * *